United States Patent [19]

Fegley et al.

[11] 4,024,986

[45] * May 24, 1977

[54] FLUID DISPENSING ANTI-BURGLAR DEVICE

[76] Inventors: Charles R. Fegley, 1606 Frusa Valley Rd., Laureldale 19605
Werner F. Esseluhn, 12 Larchwood Rd., Wyomissing, Pa. 19603

[ * ] Notice: The portion of the term of this patent subsequent to Aug. 12, 1992, has been disclaimed.

[22] Filed: Feb. 3, 1976

[21] Appl. No.: 654,861

Related U.S. Application Data

[63] Continuation-in-part of Ser. No. 549,020, Feb. 10, 1975, abandoned.

[52] U.S. Cl. ..... 222/5; 109/31; 116/6; 116/86; 222/39; 222/153; 222/325

[51] Int. Cl.[2] ..... G08B 13/08; G08B 15/02

[58] Field of Search ..... 222/5, 3, 180–183, 222/325, 153, 394, 39, 83.5, 320; 116/86, 12, 6, 8–9; 239/274; 9/316–320; 109/20, 33, 29, 31

[56] References Cited

UNITED STATES PATENTS

| | | | |
|---|---|---|---|
| 3,266,668 | 8/1966 | Davis | 222/5 |
| 3,690,286 | 9/1972 | Gantt | 116/86 |
| 3,757,371 | 9/1973 | Martin | 9/316 |
| 3,899,105 | 8/1975 | Fegley et al. | 222/5 |

*Primary Examiner*—Robert B. Reeves
*Assistant Examiner*—John P. Shannon

[57] ABSTRACT

A fluid dispensing anti-burglar device is disclosed which discharges a fluid, containing a chemical such as tear gas, into an area to be protected when an intruder opens a window or a door or forces open a window or a door to enter a private or unauthorized area with which the device is associated. The anti-burglar device employs a spring biased actuating member for discharging a pressurized container. A mechanical trigger for releasably retaining the actuating member in a cocked position and for releasing the actuating member to dispense the fluid, containing a chemical such as tear gas, is described. In addition, a lock mechanism to place the device in a non-triggerable condition is also shown.

12 Claims, 22 Drawing Figures

FLUID DISPENSING ANTI-BURGLAR DEVICE

This is a continuation-in-part of application Ser. No. 549,020 filed Feb. 10, 1975 and is now abandoned.

BACKGROUND OF THE INVENTION

The invention relates generally to an anti-burglary device and more particularly to an anti-burglary device which dispenses a fluid containing a chemical such as tear gas from a pressurized container, one type of which is an aerosol container, into a protected area upon actuation by an unauthorized person, causing the protected area to be flooded with a chemical, thereby, forcing evacuation of the protected area by the intruder; but the invention is not limited to the use of the aerosol type container.

Chemical weapons have been known in the art for many years. One type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglary device discharges an explosive tear gas shell into a area but this type is both dangerous and very limited as to the amount of tear gas which is discharged into the area to be protected.

Thus, what is needed is an anti-burglar device of the fluid dispensing booby-trap type which can be actuated by a small amount of mechanical force, yet release a sufficient amount of fluid containing a chemical into a given area to force evacuation by an intruder. The anti-burglar device uses a pressurized container having a fluid-dispensing element which is actuated by a dispensing element actuating means associated with a biased actuating member. Although, a relatively heavy spring is applied to the actuating member to provide sufficient force to actuate the dispensing element of the pressurized container; the actuating member can be positively secured against accidental release. When the device is triggered by an intruder, the actuating member causes the release of a sufficient volume of chemical from the pressurized container into the protected area to force evacuation by the intruder.

SUMMARY OF THE INVENTION

The principle object of the present invention is to provide an anti-burglary device of the fluid dispensing type which may be triggered directly by a small amount of mechanical movement, and yet is positively secured against accidental release by a lock mechanism.

A further object of the invention is to provide an anti-burglar device of the chemical weapon type which is readily triggered by opening a door or other entry means by an intruder entering an unauthorized area.

Another object of the invention is to provide an improved means of spraying or discharging a fluid containing a chemical into the protected area in a minimum amount of time in order to force the intruder from the protected area and to prevent the intruder from re-entering the protected area for a reasonable amount of time.

A further object of the invention is to provide an anti-burglar device having means for reloading the device and resetting the actuating member of the weapon in its cocked position after the device has been discharged.

Another object of the present invention is to provide a directable emission of the fluid, such as by means of rotatably adjustable dispensing head, so that the device might be located on a door, and yet, when the door is opened, direct the fluid into the protected area.

According to the principle aspect of the present invention, there is provided an improved means for releasably retaining a spring biased actuating member of the anti-burglary device in its cocked position. Such means includes a trigger adapted to be movably mounted in an holding position and a release position. The trigger, when in the actuation position, releasably retains the actuating member in a cocked position, whereby a dispensing element actuating means associated with the actuating member is displaced from the fluid dispensing element of the pressurized container.

The trigger and the biased actuating member are arranged such that the spring associated with the actuating member will cause the trigger to be moved to a release position whereby the pressurized container is discharged. A latch plate, mounted on or connected to any movable object, may be used to prevent movement of the trigger, thereby, retaining the trigger and the biased actuating member in the actuation position. When the movable object is moved away from the trigger, the trigger is caused to move to a release position by the spring biased actuating member, whereby the dispensing element actuating means associated with the actuating member engages with and actuates the dispensing element of the pressurized container; thereby causing the discharge of the fluid containing a chemical.

Since the trigger is rotatable and has a mechanical advantage, a relatively small amount of force is required to hold the trigger in the actuation position even though a relatively strong spring is employed for forcing the actuating member toward the pressurized container. Therefore, very little force is exerted on the latch plate by the trigger and will not be detected by the intruder.

In order to retain the spring biased actuating member safely in its cocked position against accidental release a locking mechanism may be used in releasable engagement with the trigger such that the locking mechanism locks the trigger in its actuation position. When the device is unlocked and an unauthorized person enters the protected area, the trigger is released from the latch plate causing the spring biased actuating member to be thrust toward the container, thereby causing fluid discharge. When the device is locked the trigger is held in a locked condition. The trigger is shaped so as to exert only a small amount of force on the locking lever. The locking lever nevertheless can retain the trigger safely against accidental release from mechanical shock.

The anti-burglary device of the fluid dispensing type of the present invention may be utilized in homes, factories, farms, office buildings by attaching the device to doors, windows, skylights, etc. and may be used in connection with vehicles such as boats, trucks, etc. The device may also be employed for any other application wherein it is desired to prevent unauthorized persons from moving certain objects by placing the mounted device against any other wall or object in place of latch plate to prevent the unlocked device from firing until unauthorized movement of the objects.

Once actuated, the discharge cannot be turned off by the intruder and the entire amount of pressurized fluid will be discharged into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 2:
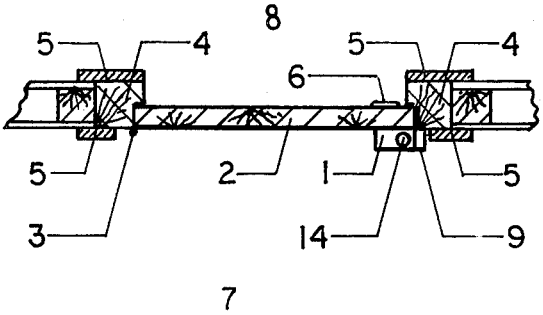
FIG. 2 is a top plan sectional view taken along line A—A of FIG. 1.
Figure 1:
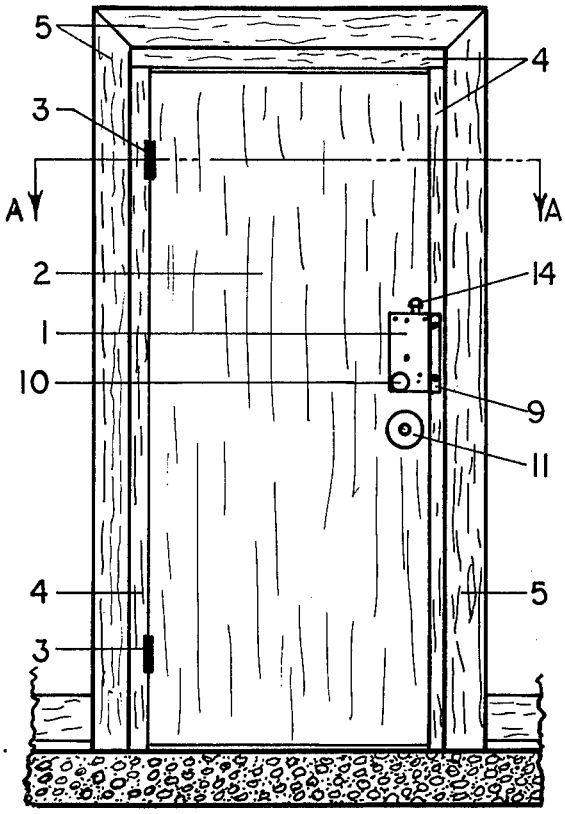
FIG. 1 is an elevational view of a wall of a room having one embodiment of the anti-burglary fluid dispensing device of the present invention fastened to the door and secured by means of a latch plate attached to the frame of the door.
Figure 3:
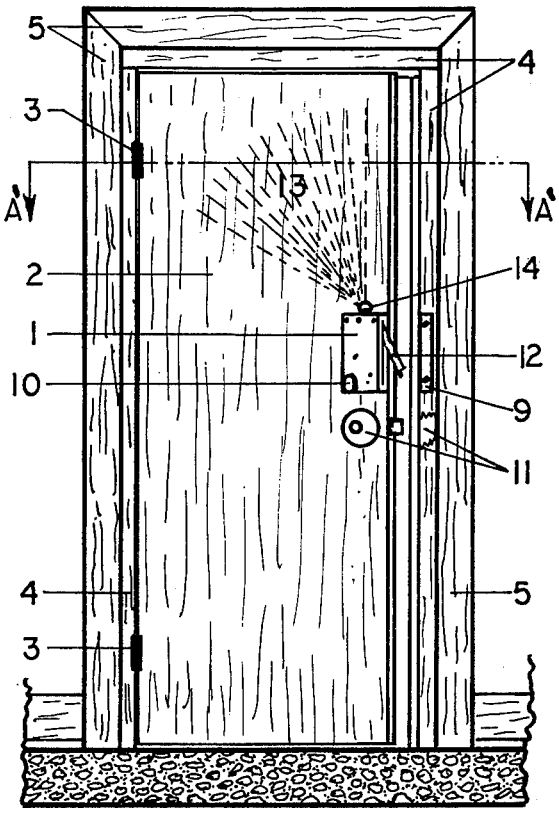
FIG. 3 is an elevational similar to FIG. 1, but showing the door open and showing the device discharging its spray.

Referring now to the drawings in detail, wherein like reference characters designate like parts throughout the various views, there is shown in FIGS 1–15, one form of the fluid dispensing device, called device hereafter generally designated 1. In FIGS. 1 and 2, the device 1 is shown secured to a door 2 with its trigger 12 retained by a latch plate 9. The latch plate is mounted on door frame 4 so that the opening of the door 2 by a burglar or intruder will move the device 1 away from the latch plate 9, whereby the device 1 will be actuated to dispense a fluid 13 generally containing a chemical such as tear gas into the restricted area 7, as best seen in FIG. 3. The device 1 can be placed into a locked condition by locking the device with key cylinder or combination lock mechanism 6 external to the restricted area or by locking knob 10 mounted on the device.

Figure 6:
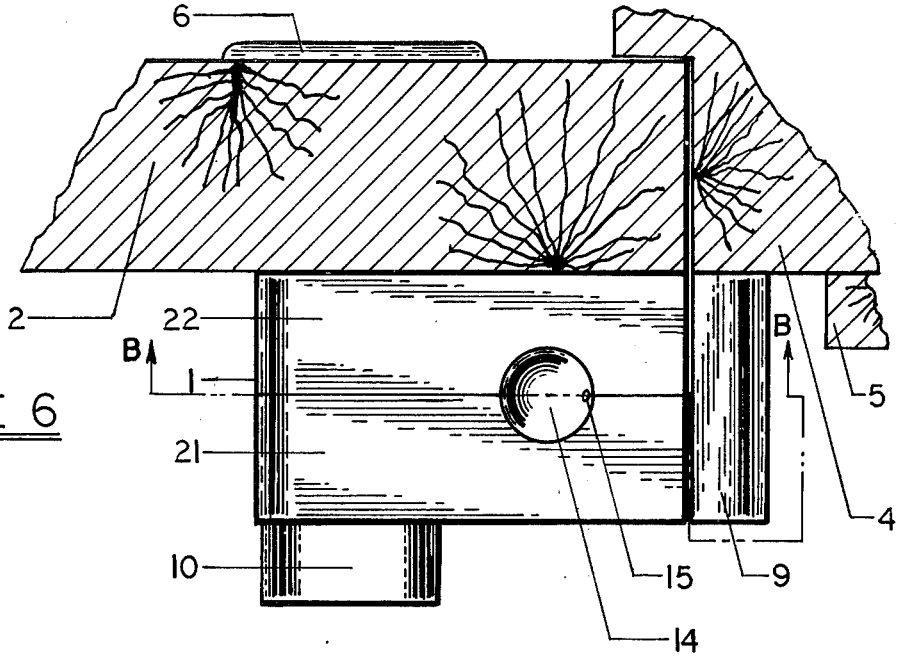
FIG. 6 is a top plan view of the anti-burglary fluid dispensing device.
Figure 7:
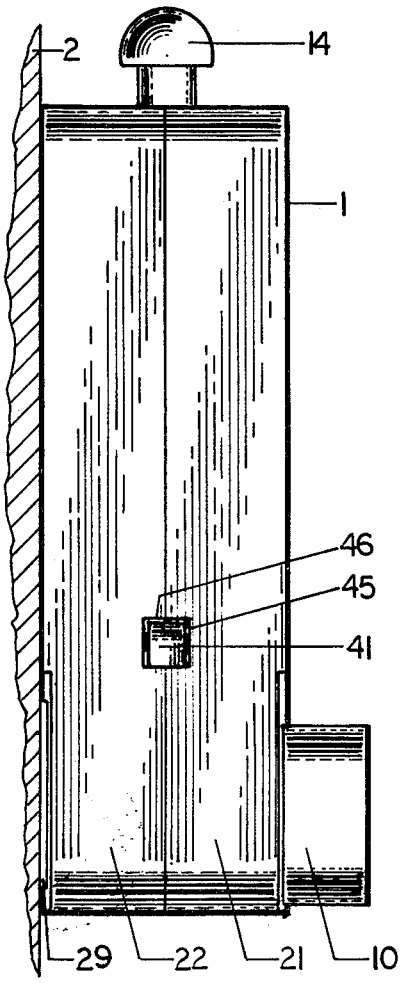
FIG. 7 is a left side elevational view of the anti-burglary fluid dispensing device.
Figure 5:
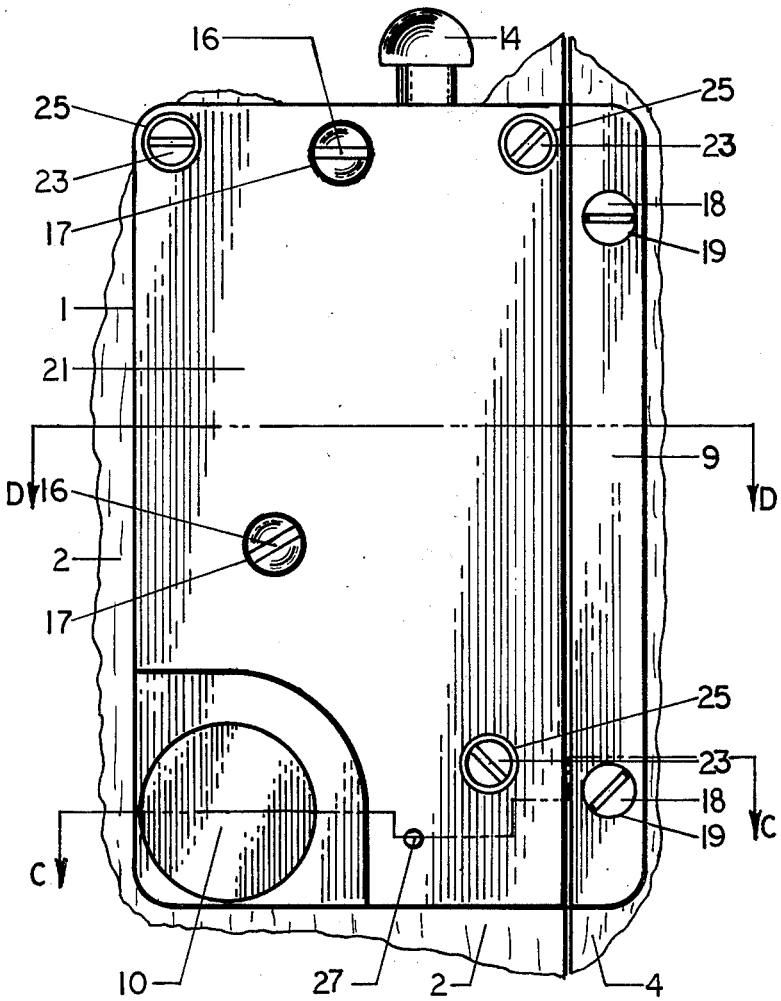
FIG. 5 is a front elevational view of the anti-burglary fluid dispensing device.
Figure 8:
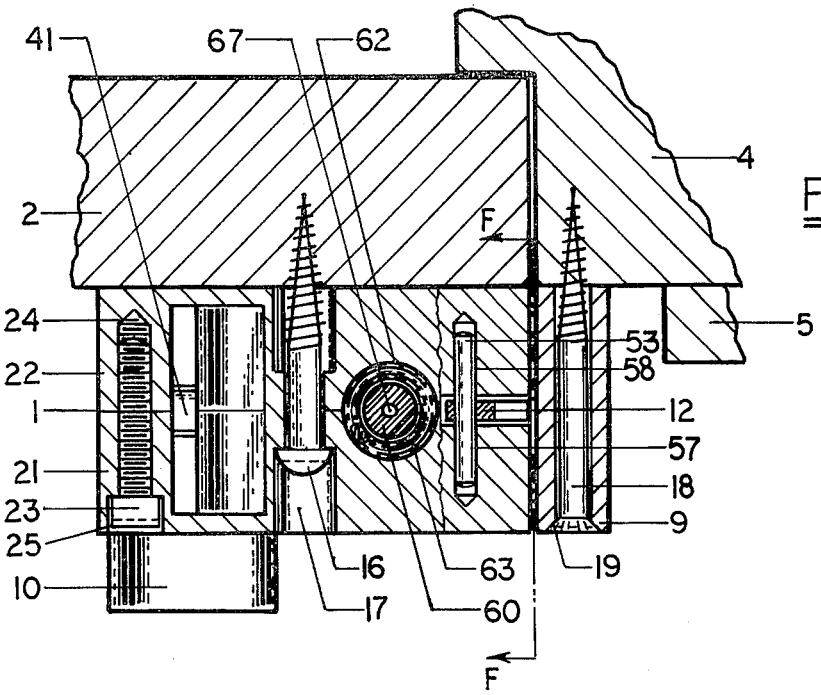
FIG. 8 is a vertical sectional view taken along line B—B of FIG. 6.

The device whose front, top and left side are shown in FIGS. 5, 6, and 7 contains a pressurized container 70 subsequently shown in FIGS 10, 11, 13, 14 and 15 mounted in a body member shown as being comprised of a right housing half 21 and a left housing half 22. The housing halves 21 and 22 when assembled provide two similar sides for mounting the device 1 to the door 2 on either right or left side of door 2 depending upon the location of the door hinges 3. Mounting screws 16 passing through mounting holes 17 fasten the device to the door 2 as shown in FIG. 8. The device latch plate 9 is mounted to the door frame 4 with screws 18 passing through mounting holes 19. The housing halves 21 and 22 are shown assembled in FIGS 5, 6, 7, and 8 with assembly screws 23 passing through the stepped assembly screw holes 25 in housing half 21 to engage the threaded holes 24 of housing half 22.

The pressurized container cavity 69 is formed when the symetrically opposite housing halves 21 and 22 are joined together as shown in FIGS. 5, 6, 7, 8, 9, 10, 13, 14 and 15. Similarly formed and coaxial with said container cavity 69 are the spring cavity 62, and the actuating member cavity 64.

Figure 20:
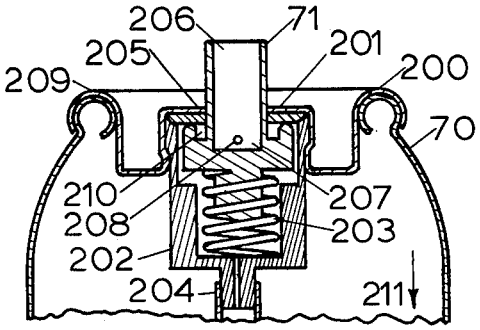
FIG. 20 is a partial vertical section showing a valve for use with the pressurized container having a projecting dispensing spout.

One type of pressurized container 70, shown as having a fluid-dispensing element in the form of a projecting dispensing spout 71, for use in this embodiment is shown in FIG. 20 as containing a valve assembly generally designated 200. Valve assemblies of this type are well known in the trade and one type of which is sold by Scovill, Manchester, New Hampshire as their 5–63 valve assembly. The valve assembly 200 is shown as being comprised of a projecting dispensing spout 71 which has generally a hollow tube portion 206 and is closed at one end thereof. A valve seat 205 is formed around the sealed end 207 of the dispensing spout 71 and contains a recessed portion 210 formed to provide a fluid passageway which will permit fluid flow to a discharge hold 208 and give fluid access to the hollow tube 206. The dispensing spout 71 is slidably mounted in spring cup 202 and is urged by spring 203 toward the valve seal 201. In this position, the valve seat 205 forms a seal with valve seal 201. A dip tube 204 may be attached to the spring cup 202 to provide access to fluid when in liquid form in the bottom of the pressurized container. The assembly is generally mounted in a metal cup 209 which is then fastened to the pressurized container 70.

When the dispensing spout 71 is moved in direction 211, the valve seat 205 is separated from the valve seal 201 thereby permitting fluid under pressure to flow up dip tube 204, around the valve seat 205, through the discharge hole 208 and out the hollow tube 206.

Figure 11:
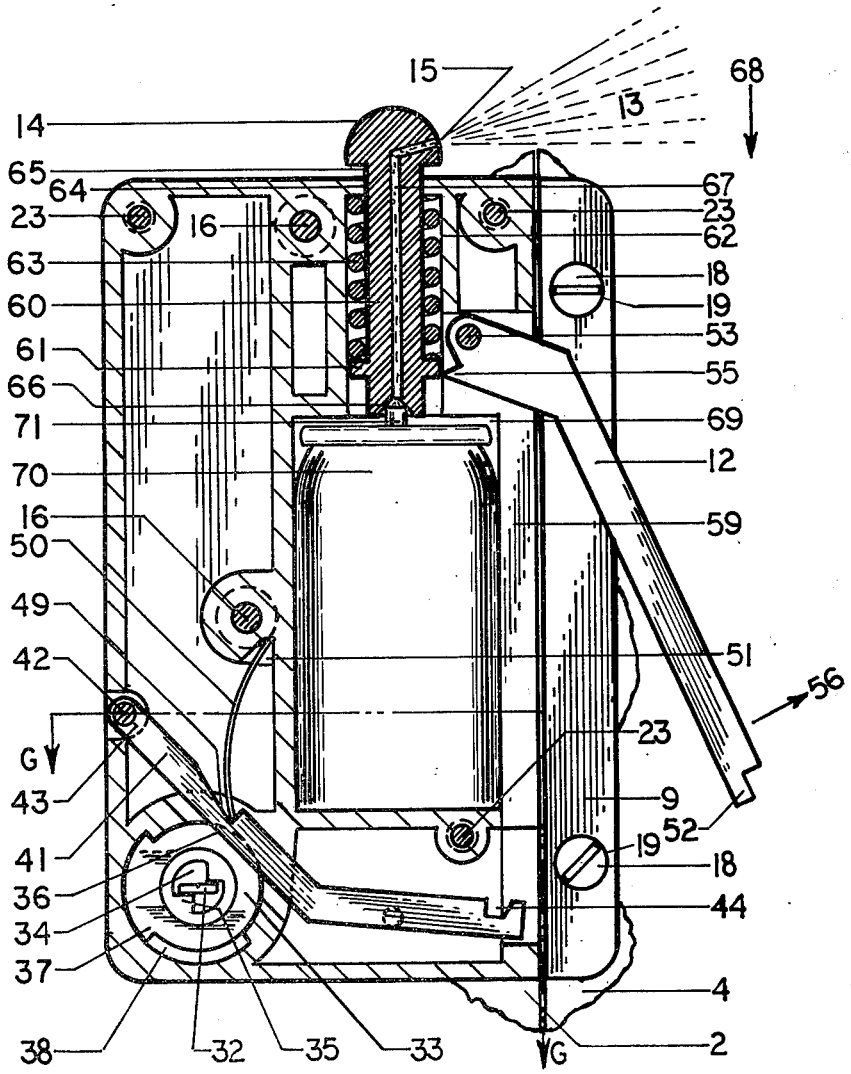
FIG. 11 is a vertical section similar to FIG. 8 but showing the anti-burglary device in its released position.

The pressurized container 70, hereafter referred to as container 70, is retained in cavity 69. The coaxially retained spring biased actuating member 14, hereafter referred to as actuating member 14, is biased by the force of spring 63 in the direction of the container 70. When the actuating member 14 is moved in direction 68, the projecting spout 71 is seated into passageway entry 66 of the actuating member 14. The material used for projecting spout 71 is relatively soft and therefore effects an adequate seal at the passageway entry 66 to retain the fluid at the pressures normally used in the container 70. The container 70 illustrated in FIG. 11 is in its released position where the container projecting spout 71 is seated into the passageway entry 66.

Figure 10:
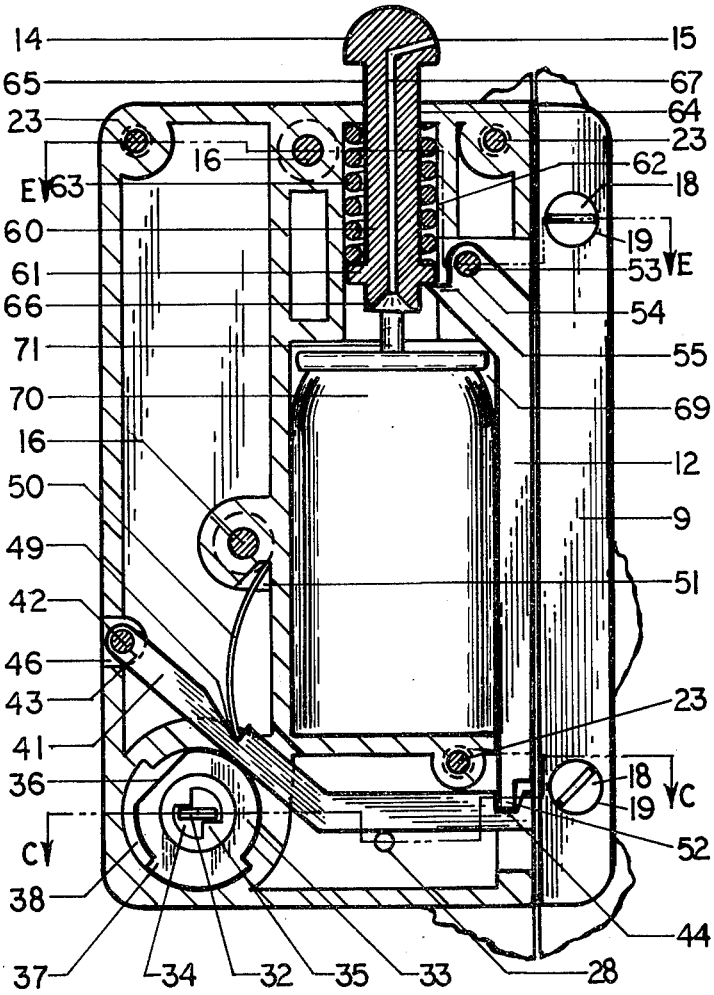
FIG. 10 is a horizontal fragmented sectional view taken along line E—E of FIG. 8.
Figure 9:
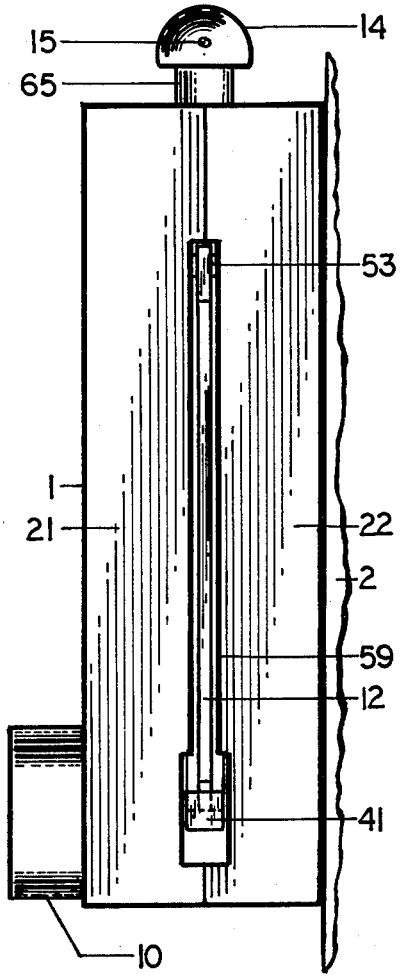
FIG. 9 is a right side elevational view taken along line F—F of FIG. 10.
Figure 13:
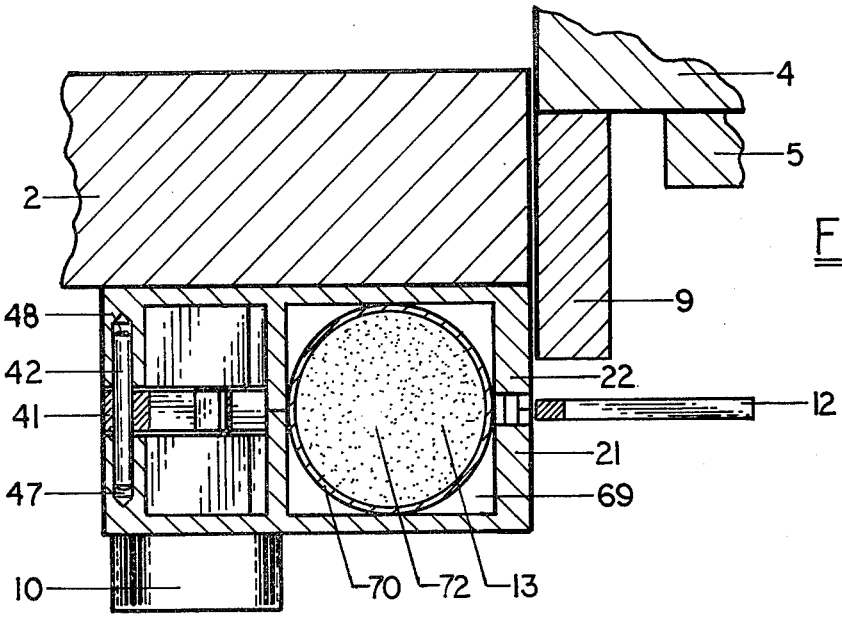
FIG. 13 is a horizontal sectional view taken along line G—G of FIG. 11.

As illustrated in FIGS. 8 and 10, the actuating member 14 is in its cocked position wherein the spring 63 is compresssed and the entry section 66 of passageway 67 is displaced from the projecting spout 71 of the pressurized container 70. The actuating member 14 is releasably retained in a cocked position by trigger 12. The trigger 12 is movably mounted in the body member and arranged to be moved from an holding position to a release position by the spring 63 associated with the actuating member 14. One such means for movably mounting the trigger 12 is shown as having the trigger 12, generally a flat member having a pivot hole 54, rotatably mounted on a pivot pin 53 which is supported in holes 57 and 58 and is slidably contained in slot 59 formed by the housing halves 21 and 22. A shaped portion 55 engages with the rim 61 of the actuating member 14 to hold the actuating member 14 in a cocked position when the trigger 12 is held in the actuation position by a holding means or a locking means. One type of holding means is shown as a latch plate 9 engaging with a surface of the trigger 12 wherein the latch plate 9 prevents movement of the trigger 12. The latch plate 9 and the device 1 are mounted in a manner that the device 1 and latch plate 9 can be moved apart from each other. The latch plate 9 mounted in a first position will retain the trigger 12 in an holding position and when moved to a second position apart from device 1 will permit the release of the trigger 12 whereby the spring urged actuating member 14 moves to engage with and release the fluid discharge containing a chemical such as tear gas. The door frame 4 and door 2 are used to one method of mounting the anti-burglar device.

A means for locking the trigger 12 in its holding position, whereby the actuating member 14 is retained in its cocked position, is shown in FIGS. 8 and 10. A cam-operated locking lever 41 engages the catch portion 52 of trigger 12 with its catch notch 44 and is generally a square cross-sectioned member which includes the catch notch 44, spring notch 44 and hole 43 and is best seen in FIGS. 8 through 14. The cam-operated locking lever 41 is rotatably mounted on a pivot pin 42 which is supported in holes 47 and 48 and is slidably contained in a slot 45 and guide surfaces 46 formed by the housing halves 21 and 22. The cam-operated locking lever 41 is held against locking cam 33 by the spring member 50 which is compressed between the spring notch 49 of locking lever 41 and is slidably contained by cavity 51 as shown in FIGS. 8, 10, 11 and 13.

Figure 12:
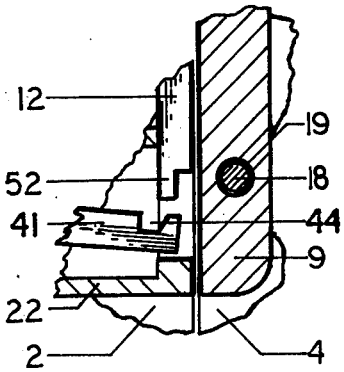
FIG. 12 is a partial vertical section similar to FIG. 8 but showing the anti-burglary device in its unlocked but nonreleased position.
Figure 14:
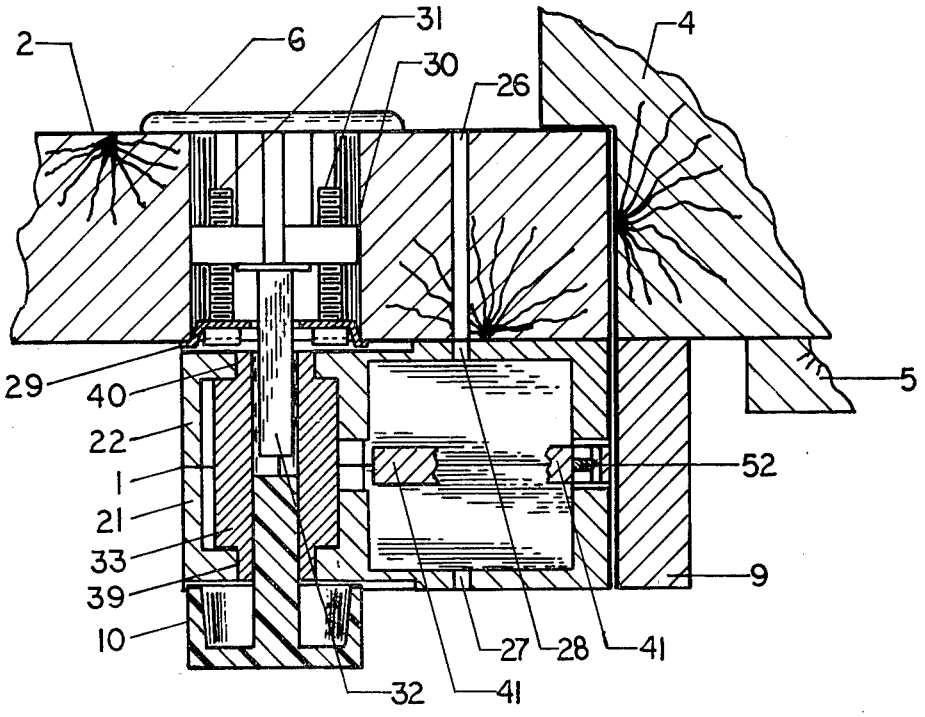
FIG. 14 is a horizontal sectional view taken along line C—C of FIGS. 5 and 8 showing the device in conjunction with a cylinder lock assembly.

In order to place the device 1 into an unlocked condition against the latch plate 9, as shown in FIGS. 1 and 2 and 8, the cam-operated locking lever 41 must be rotated so the catch notch 44 disengages from the catch 52 of the trigger 12 so that trigger 12 is held from rotatably releasing the spring biased actuating member 14 by latch plate 9. This unlocked position is accomplished by the rotation of the locking cam 33 in a clockwise direction for 90° so that cam flat 36 allows locking lever 41 to move from engagement with trigger 12 as shown in FIGS. 8, 11 and 12, FIG. 12 showing the unlocked but unactuated position of trigger 12 and locking lever 41. The locking cam 33 is rotatably mounted in holes 39 and 40 and cavities 38 of housing halves 21 and 22 as best seen in FIG. 14. The cavities 38 are shaped so that the locking cam surface is guided and rotation is limited by protrusion 37 engaging with similar rotation limiting portions of cavities 38 so as to restrict rotation of locking cam 33 to 90°.

Figure 4:
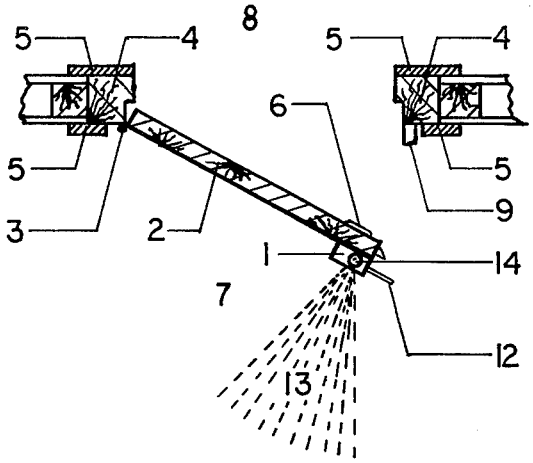
FIG. 4 is a top plan sectional view taken along A'—A' of FIG. 3.

The locking cam 33 is rotated from the position shown in FIG. 8 to the position shown in FIG. 11 by inserting and rotating a key, not shown, 90° in cylinder lock assembly 6 shown in FIGS. 14. The lock assembly's blade 32 located in the 90° rotation allowing hole 34 hereafter designated as hole 34 c an rotate the cam 33, 90° and yet permit a return of 90° by the lock assembly blade. This feature, common to many commercially available lock assemblies is necessary to permit removal of the key. Since most lock assemblies require a rotation in one direction to lock and the opposite to unlock from a key entry position and return to that position for key removal upon completion of the function desired; it can readily be seen in FIG. 11 that the blade is now in position to perform the locking sequence should the device 1 not be actuated by forced or unauthorized entry to the restricted area 7 as shown in FIGS. 3 and 4.

The lock assembly 6 is shown in FIG. 14 mounted on door 2 in hole 30 and is held in place by the lock mounting retainer plate 29 by use of lock assembly mounting screws 31. The device 1 is mounted on the door 2 with the device mounting screws 16 passing through mounting holes 17 so that the locking cam hole 34 will slide over the lock assembly's blade 32 and permit ease of rotation of the locking cam.

Locking knob 10, which is shaped to press fit into lockcam hole 34, permits locking and unlocking of the device 1 from the restricted area 7. This feature is desirable when more than one door, window, etc, provide access to the restricted area 7 and exit from that area requires only use of one door.

A desirable feature of the device 1 is shown in FIGS. 5, 8, 11 and especially 14 and consists of holes 27 and 28 in housing halves 21 and 22 concentric and in-line with hole 26 in door 2. Hole 26 is located from the holes 27 and 28 during mounting of the device 1 on door 2. The in-line hole can now be used to check the condition, actuated or not, of the device 1 by visual or mechanical means. If insufficient light is available, a pin of specific length whose diameter is small enough to fit holes 26, 27, and 28 may be used to probe the devices' condition. As an additional desired embodiment a self contained light source such as a light emitting diode, battery and cam-operated locking lever 41 actuated switch could be contained within the unused cavities formed in the body member of device 1 with the light emitting diode located in the housing half furtherest from the door 2. The holes 27 and 28 provide an additional means of locking the device 1 against accidental or unintentional triggering when the device 1 is not engaged with latch plate 9 such as is shown in FIGS. 3 and 4 by operation of the knob 10 or lock assembly 6. A pin, not shown, of a diameter slightly smaller than holes 27 and 28 and longer than the combined thickness of body halves 21 and 22, may be slidably inserted into the holes when the device is in the condition shown in FIG. 8 to prevent the clockwise movement of the locking lever 41 in such a manner as to keep the device in a non-actuable condition.

The lock assembly 6 is shown in FIGS. 2, 4, 6 and 14, one type of which is commercially available from manufacturers such as Chicago Lock Co., 4311 Belmont Avenue, Chicago, Ill. 60641 (Model 4031) or the Eaton Corp., Yale Lock and Hardware Division, Rye, N.Y. 10580.

Figure 15:
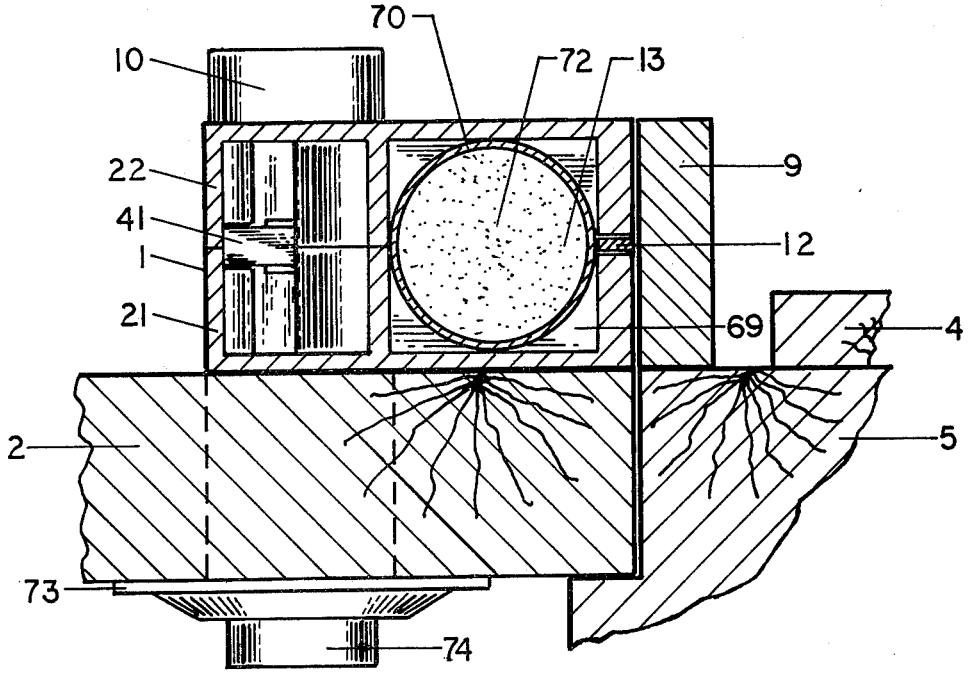
FIG. 15 is a horizontal sectional view taken along line D—D of FIG. 5 when the device is mounted on a door hinged different than that shown in FIGS. 1 through 14. A combination type lock assembly is also shown.

The device 1 is not limited to use of the lock assembly type shown in FIGS. 2, 4, 6 and 14 and may be used with other types of lock assemblies such as the combination lock assembly 73 and dial knob 74 are shown in FIG. 15 which also shows an alternate mounting and assembly of device 1 on door 2. A pushbutton lock assembly such as manufactured by the Simplex Security Systems Company, 10 Front Street, Collinsville, Conn. 06022 could also be effectively utilized to actuate and deactuate the device.

In the unlocked, actuatable condition shown by FIGS. 1, 2, 11, 12, the device protects the restricted area 7 from entry from accessable area 8 even though the door 2, generally secured to frame 4 by hinges 3 and the doors latch mechanism 11 and latch plate 26 recessed in frame 4. Upon unauthorized entry to restricted area 7 by forcing open door 2, as shown in FIG. 3, the device 1 is actuated. As the door 2 rotatably moves into the restricted area 7 such as a home, apartment or office, etc. The device 1 slidably moves away from latch plate 9 as shown in FIGS. 3, 4, 11 and 13. As soon as the trigger 12 slides from its engagement with latch plate 9, it is free to be cammed out of its holding position by the force of spring 63 slidably moving actuating member 14 in direction 68, the rim 61 of the actuating member 14 slidably forcing the shaped trigger catch portion 55 of the trigger 12 in such manner as to move trigger 12 out of slot 59 in direction 56. The actuating member 14 continues to move in direction 68 to seat container projecting spout 71 firmly in passageway entry 66 and depress projecting spout 71 into container 70 causing the fluid 13 to be dispensed through the actuating member 14, passageway entry 66 of the passageway 67 and dispensing orifice 15 into restricted area 7 as shown in FIGS. 3, 4, and 11.

After the device has been fired in the manner described herein above, the housing halves can be separated to replace the container 70. After restoring trigger 12 and actuating member 14 to their cocked position as depicted in FIG. 8, it can be reused.

Yet another important feature is that the actuating member 14 is rotatable through a large angle up to 360° so that the fluid 13 may be directed from orifice 15 into any direction relative to the triggering object.

Another important feature is that the spring 63 be of substantial force so that the container projecting spout 71 will seat in the passageway entry 66 with sufficient force to release the pressurized chemical through the passageway 67 and out the dispensing orifice 15.

It is also important in this embodiment that the fluid-dispensing element comprises of a dispensing valve 200 having a projecting dispensing spout 71 which when depressed causes fluid discharge therethrough. The biased actuating member 14 contains a fluid passageway 67 and the fluid-dispersing element actuating means in the form of a funnel shaped entry section 66 which engages the projecting dispensing spout 71 and forms a seal between the entry section 66 of passageway 67 and the projecting dispensing spout 71.

When the restricted area 7 is not violated by unauthorized entry, the device may be returned to a locked, unactuatable condition by operating the lock assembly 6 or the locking knob 10 so that the locking cam 33 is returned to the position shown in FIG. 8. The locking lever 41 is rotated to engage catch 52 of the trigger 12 with catch notch 44 which locks trigger 12 in place so that device 1 no longer can be actuated when moved away from latch plate 9.

Figure 16:
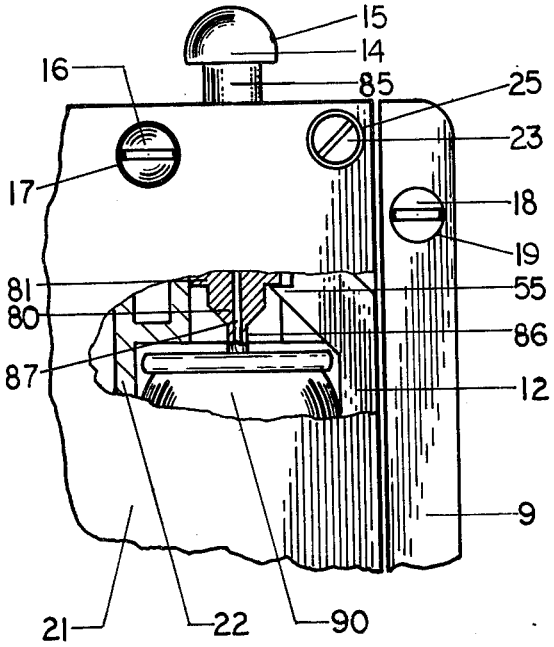
FIG. 16 is a partial vertical section taken along line B—B of FIG. 6 similar to the section shown in FIG. 8 but showing a second embodiment of the device.

A second embodiment of the invention is illustrated in FIG. 16. In this embodiment the basic structure is as previously described and like numbers are used to indicate like or corresponding parts.

In this embodiment, the pressurized container 70, shown in FIG. 8 having a projecting dispensing spout 71, is replaced with a pressurized container 90, shown in FIG. 16, having a recessed valve. Pressurized containers with recessed valves are well known in the trade. In addition the funnel shape of the entry section 66 of passageway 67 of the first embodiment shown in FIG. 8 is replaced with a projecting spout 86 depending from actuating member 81 all of which is shown in FIG. 16.

In this embodiment, all elements function as described in the first embodiment with the following difference. The pressurized container 90 is discharged by the action of the projecting spout 86 of the actuating member 81 engaging with and depressing the recessed valve and thereby causing discharge.

Figure 21:
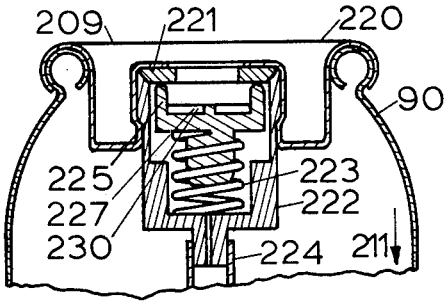
FIG. 21 is a partial vertical section showing a valve for use with a pressurized container having a recessed valve.

One type of recessed valve for use in this embodiment is shown in FIG. 21 and is generally designated 220. Valve assemblies of this type are well known in the trade. The valve assembly 220 is shown as being comprised of a valve seat 225 mounted in a spring cup 222. The valve seat 225 contains a recessed portion 230 and recessed channels 227 formed in valve seat 225.

The valve seat 225 is slidably mounted in spring cup 222 and is urged by spring 223 toward seal 221. In this position, the valve seat 225 forms a seal with the valve seal 221. The valve assembly 220 is generally mounted in a metal cup 209 which is then fastened to the pressurized container 90.

When the device 1 is triggered, the actuating member 81 moves toward the pressurized container 90. As movement continues, the projecting spout 86 depending from the actuating member 81 engages with and moves the valve seat 225 from engagement with valve seal 221, permitting fluid under pressure to flow around the valve seat 225, through channels 227 and out passageway 55. When the projecting spout 86 entered the valve assembly 220, the valve seal 221, being made of resilient material, formed a seal between the circumference of the projecting spout 86 and the valve seal 221, thus preventing fluid leakage.

It is important in this embodiment that the fluid-dispensing element comprise of a recessed valve 220 which when depressed causes fluid discharge therethrough and that the actuating member 81 contains the dispensing element actuating means in the form of a projecting spout 86 which engages with and depresses the recessed valve.

Figure 17:
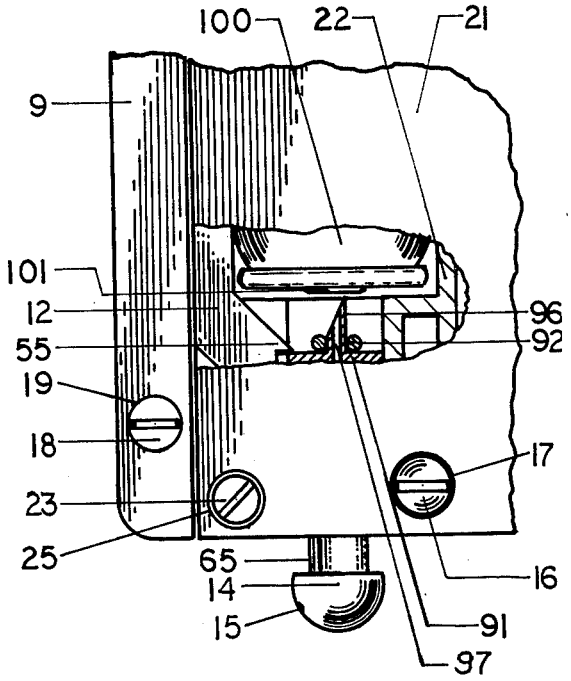
FIG. 17 is a partial vertical section taken along line B—B of FIG. 6 similar to the section shown in FIG. 8 but inverted and showing a third embodiment of the device.

A third embodiment of the invention is illustrated in FIG. 17. In this embodiment, the basic structure is as previously described in the first embodiment and like numbers are used to indicate like or corresponding parts.

In this embodiment, the pressurized container 70, shown in FIG. 8 of the first embodiment having a projecting spout 71, is replaced with a pressurized container 100 shown in FIG. 17 as having a pierceable seal 101. Pressurized containers having pierceable seals are well known in the trade. In addition, the funnel shaped entry section 66 of passageway 67 is replaced by a projecting piercing section 97 shaped to pierce seal 101.

Now referring to FIG. 17, FIG. 17 is an inverted embodiment of FIG. 8 of the first embodiment in which all elements function as described in the first embodiment with the following exceptions. The pressurized container 100 is pierced by the action of the projection piercing section 97. As the pierceable seal is pierced, a seal is formed by the action of the O-ring 92 and its retaining seat 91 and the pierceable seal 101.

It is important in this embodiment that the fluid-dispensing element comprises a pierceable seal 101 which when pierced will permit fluid flow therethrough. It is also important that the dispensing element actuating means comprise of a projecting piercing section 96 set in a position to pierce the pierceable seal 101 when the actuating member 65 is moved toward it. It is also important that a seal be made around the projecting piercing section 96 to prevent fluid leakage within the body member after the pierceable seal 101 is pierced.

Figure 18:
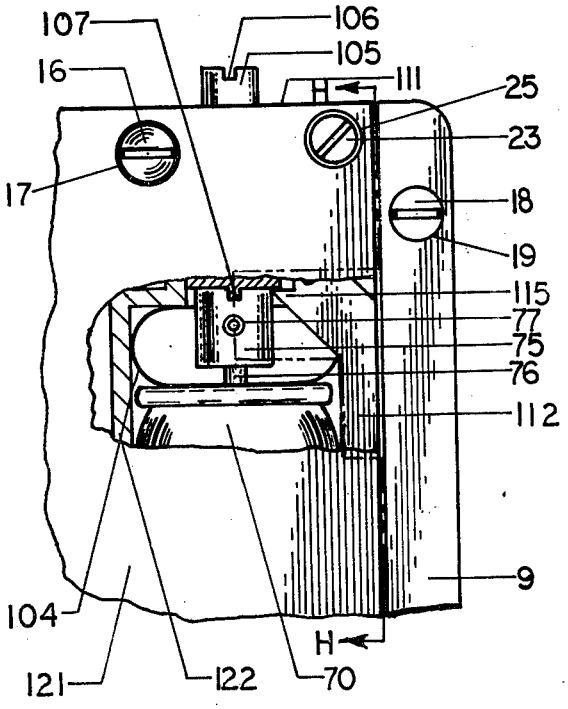
FIG. 18 is a partial vertical section taken along line B—B of FIG. 6 similar to the section shown in FIG. 8 but showing a fourth embodiment of the device.
Figure 19:
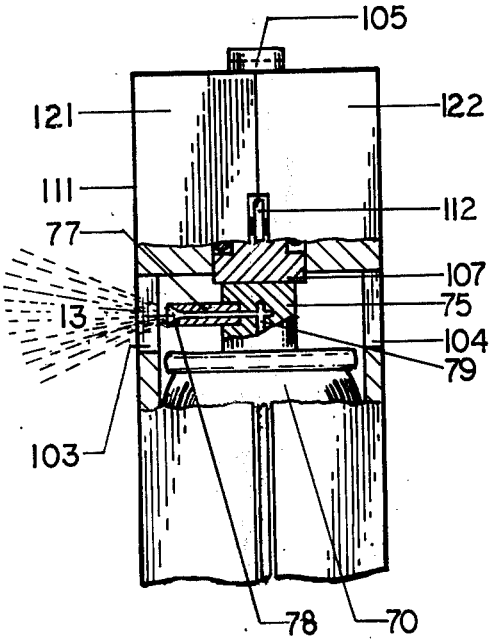
FIG. 19 is a partial vertical section taken along line H—H of FIG. 18 but showing the fourth embodiment in its released and dispensing condition.

A fourth embodiment of the invention is illustrated in FIGS. 18 and 19. In this embodiment, the basic structure is as previously described in the first embodiment and like numbers are used to indicate like or similar parts.

In this embodiment, the projecting dispensing spout 71 of pressurized container 31, shown in FIG. 8, is replaced with a projecting dispensing cap 75 shown in FIGS. 18 and 19. In addition, the fluid passageway 67 and the entry section 66 are replaced with an aperture 72.

Now referring to FIGS. 18 and 19, the trigger 12 and the spring 63 operate as before to move the actuating member 105. In this embodiment, the spring urged actuating member 105 causes the projecting cap 76 to be depressed, thereby causing discharge.

It is important that the fluid-dispensing element comprise of a projecting dispensing cap 75 which when depressed causes fluid discharge therethrough. The body member contains apertures 103 and 104 in communication with the projecting dispensing cap 75 to provide for fluid discharge from the device. A dispensing element actuating means is provided by the surface of the actuating member 105 which will depress the dispensing cap 75 when the actuating member is released and thereby cause fluid discharge.

Figure 22:
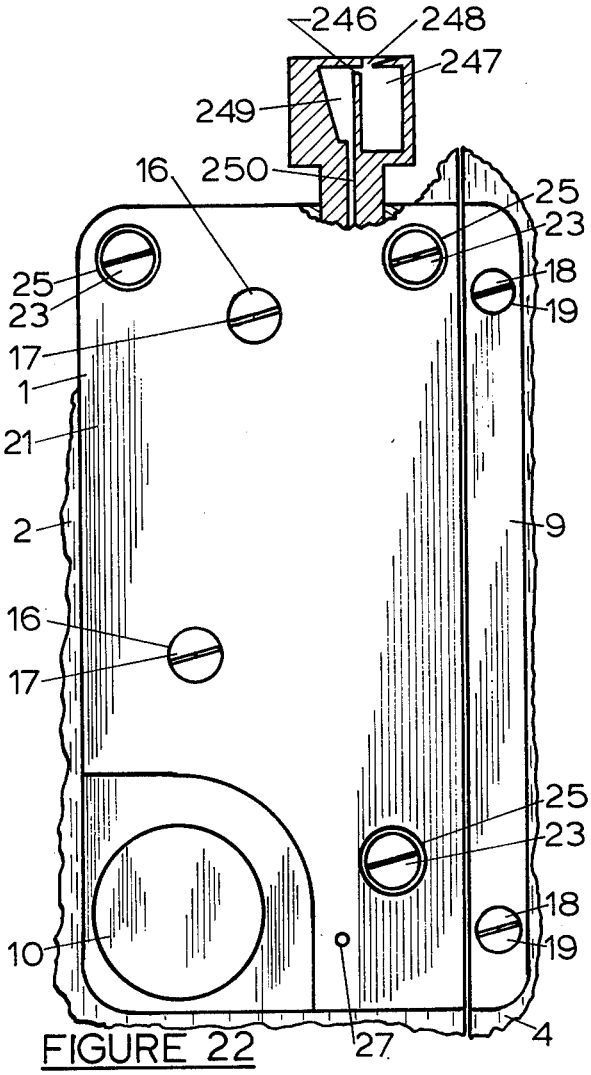
FIG. 22 is a partial vertical elevational view similar to FIG. 5 but showing a means for producing sound.

A fifth embodiment of the invention in illustrated in FIG. 22. In this embodiment the basic structure is as previously described and like numbers are used to indicate like or corresponding parts.

In this embodiment, the orifice 15 is replaced with a shaped chamber 246 and discharge portion 248. All elements function as previously described in the first embodiment with the following difference. As the pressurized container is discharged, the fluid 13 is discharged through the valve 200, through the passageway 250 into chamber 249, through the horizontal passageway 246 and out slot 248, then into the protected area. As the fluid 13, is being discharged, a whistle like sound will be produced as the fluid 13 is discharged, the pitch of which can be controlled by the chamber 247. Thereby issuing a warning sound in addition to filling the area with a chemical to protect the area where the device 1 is installed.

Although we have herein shown and described the invention in what we have conceived to be the most practical and preferred embodiments, it is recognized that departure may be made therefrom within the scope of our invention, which is not to be limited to the details disclosed herein, but is to be accorded the full scope of the claims so as to embrace any and all equivalent structures and devices.

We claim:

1. A fluid dispensing anti-burglar device for use with a pressurized container, the device comprising:

a. a body member;

b. means for supporting said pressurized container in said body member, wherein said pressurized container has a fluid-dispensing element adapted to release fluid under pressure from said pressurized container when actuated;

c. an actuating member containing a dispensing element actuating means adapted to engage and actuate said fluid dispensing element;

d. a passageway in said dispensing element actuating means having an entry section at one end thereof, said entry section in communication with said fluid dispensing-element;

e. spring means biasing said actuating member slidably mounted in said body member and arranged to force said fluid-dispensing element and said dispensing element actuating means into engagement with each other, thereby causing said fluid-dispensing element to be actuated;

f. trigger means releasably retaining said spring biased actuating member in a cocked position in which said fluid-dispensing element and said dispensing element actuating means are separated from each other, said trigger means including a trigger mounted for movement within said body member between an holding position and a release position, said trigger in said holding position being in engagement with a surface of said spring biased actuating member to retain said actuating member in a cocked position, said trigger in said release position allowing said dispensing element actuating means to actuate said dispensing element and thereby cause discharge; p1 g. means for locking g. means for locking said trigger in engagement with said actuating member, said locking means being mounted for movement within said body member between a locked position and a unlocked position, said locking means in said locked position securing said trigger in engagement with said biased actuating member, and said locking means in its release position permitting the trigger to move to its release position;

h. and means external to the body member for releasably retaining the trigger in the actuation position, said external retaining means including a latch plate mounted separate from the body member, the body member being movable between a first position in which the external retaining means retains the trigger in its actuation position, and a second position in which the external retaining means allows the trigger to move to its release position.

2. The fluid dispensing anti-burglar device of claim 1 in which the pressurized container includes a pierceable section and said dispensing element actuating means comprises, means to provide a seal between said pierceable section and said entry section, and means for puncturing said pierceable section, whereby fluid may be discharged.

3. The chemical dispensing anti-burglar device of claim 2 in which said means for puncturing comprises a projecting spout depending from said actuating member.

4. The fluid dispensing anti-burglar device of claim 1 wherein said pressurized container includes a dispensing valve actuated to permit fluid discharge therethrough upon depression thereof, said valve being actuated to the depressed position through movement of said spring biased actuating member to cause depression of said valve, thus causing discharge.

5. The fluid dispensing anti-burglar device of claim 4 wherein said valved pressurized container contains a projecting dispensing spout, said dispensing spout discharging fluid upon depression thereof, said entry section being funnel shaped for receiving said projecting dispensing spout on said container.

6. The fluid dispensing anti-burglar device of claim 4 wherein said valve pressurized container includes a recessed valve, said actuating member includes a projection around said entry section extending toward said container to engage said recessed valve, said recessed valve actuated upon depression thereof to emit fluid.

7. The fluid dispensing anti-burglar device of claim 4 wherein said valved pressurized container includes a projecting dispensing cap actuated to permit fluid discharge therethrough upon depression thereof, an aperture in said body member in communication with said cap, said biased actuating member arranged to actuate said dispensing cap upon release thereby discharging said pressurized container through said cap and aperture when said biased actuating member is released.

8. The fluid dispensing anti-burglar device of claim 1 wherein said trigger is mounted for rotation between said actuation position and said release position.

9. The fluid dispensing anti-burglar device of claim 1 wherein said trigger when in said actuation position is in shouldered engagement with said actuating member to retain said actuating member in a cocked position.

10. The fluid dispensing anti-burglar device of claim 1 in which the locking means includes a combination lock assembly.

11. The fluid dispensing anti-burglar device of claim 1 in which the locking means includes a cylinder lock assembly.

12. The fluid dispensing anti-burglar device of claim 1 wherein said passageway contains a means of producing sound; said means of producing sound comprising a chamber in said passageway to cause vibrations of the fluid in said chamber resulting from oscillations produced as said fluid is flowing through a narrow slot against a knife-edge forming part of said passageway.

* * * * *